US007218295B2

(12) United States Patent
Sung

(10) Patent No.: US 7,218,295 B2
(45) Date of Patent: May 15, 2007

(54) DRIVING METHOD FOR ACTIVE MATRIX OLED DISPLAY

(75) Inventor: Chao-Chin Sung, Pingtung (TW)

(73) Assignee: AU Optronics Corp., Hsinchu (TW)

( * ) Notice: Subject to any disclaimer, the term of this patent is extended or adjusted under 35 U.S.C. 154(b) by 472 days.

(21) Appl. No.: 10/791,158

(22) Filed: Mar. 1, 2004

(65) Prior Publication Data

US 2004/0227706 A1 Nov. 18, 2004

(30) Foreign Application Priority Data

May 14, 2003 (TW) ..... 92113027 A

(51) Int. Cl.
*G09G 3/32* (2006.01)

(52) U.S. Cl. ..... 345/82; 345/76; 345/79; 345/96; 315/169.1; 315/169.3

(58) Field of Classification Search ..... 345/76, 345/79–83, 90, 92, 46, 34, 45, 95, 96, 77; 315/169.1–169, 169.03, 169.04
See application file for complete search history.

(56) References Cited

U.S. PATENT DOCUMENTS

| | | | | |
|---|---|---|---|---|
| 6,583,581 | B2 * | 6/2003 | Kaneko et al. | 315/169.3 |
| 6,809,481 | B2 * | 10/2004 | Seo et al. | 315/169.1 |
| 6,870,192 | B2 * | 3/2005 | Yamazaki et al. | 257/79 |
| 2002/0180671 | A1 * | 12/2002 | Inukai | 345/76 |
| 2003/0160745 | A1 * | 8/2003 | Osame et al. | 345/82 |

* cited by examiner

*Primary Examiner*—Richard Hjerpe
*Assistant Examiner*—Jennifer T. Nguyen
(74) *Attorney, Agent, or Firm*—Thomas, Kayden, Horstemeyer & Risley

(57) ABSTRACT

A driving method for an active matrix OLED display. In the driving method, a first current is provided to flow through an OLED of a pixel in a first period of one display period, according to a video signal on the data electrode and a scan signal on the scan electrode. Next, a second current is provided to flow through the OLED in a second period of the display period to neutralize carrier accumulation inside the OLED, wherein the first current and the second current flow in opposite directions.

6 Claims, 5 Drawing Sheets

DRIVING METHOD FOR ACTIVE MATRIX OLED DISPLAY

BACKGROUND OF THE INVENTION

1. Field of the Invention

The present invention relates to a driving method, and more particularly, to a driving method for an active matrix OLED display, as well as a pixel structure using the same.

2. Description of the Related Art

Typically, an active matrix OLED display employs a large number of pixels to present an image, and controls the brightness of each pixel according to a brightness data.

FIG. 1 shows a pixel structure 10 of an active matrix organic light emitting diode (AMOLED). The switching transistor $T_1$ is turned on and a data voltage indicated brightness is applied to a data electrode DATA when the scan electrode SCAN is activated. Thus, the storage capacitor $C_s$ is charged or discharged, and the potential at the gate of the driving transistor $T_2$ may coincide with that of the data voltage. The switching transistor $T_1$ is turned off and the driving transistor $T_2$ is electrically isolated from the data electrode DATA when the scan electrode SCAN is not activated. The data voltage is stored in the storage capacitor $C_s$, and the potential at the gate of the driving transistor $T_2$ is maintained. The produced driving current I flows to the OLED 20 through the driving transistor $T_2$ according to the voltage (Vgs) between the gate and source of the driving transistor $T_2$. The OLED 20 then continuously illuminates according to the driving current I.

That is, in one display frame, the current received by the OLED is fixed. However, this driving method accumulates carriers inside the OLED 20 which reduce the life of the OLEDs. Moreover, the voltage $V_o$ across the OLED gradually increases over time as shown in FIG. 3. Further, as shown by the formula P=I×V, as the voltage $V_o$ increases over time, the power P also increases. In FIG. 3, curve $C_1$ shows the effect of the voltage $V_o$ of the OLED over time.

SUMMARY OF THE INVENTION

It is therefore an object of the present invention to neutralize carrier accumulation in the OLED of an LCD, thereby reducing the increase in voltage and minimizing the increase in power consumption across both ends of the OLED over time, further increasing the life of the OLED.

According to the above mentioned objects, the present invention provides a driving method for an active matrix OLED display. The driving method provides a first current to flow through an OLED of a pixel in a first period of one display period, according to a video signal on the data electrode and a scan signal on the scan electrode. Next, a second current is provided to flow through the OLED in a second period of the display period to neutralize carrier accumulation inside the OLED. Wherein the first current and the second current flow in opposite directions.

According to the above mentioned objects, the present invention provides a pixel structure of an active matrix OLED display, which is capable of neutralizing carrier accumulation in an OLED. In the pixel structure of the present invention, a switching transistor has a control terminal coupled to a scan electrode and a first terminal coupled to a data electrode. A driving transistor has a control terminal coupled to a second electrode of the switching transistor and a first terminal coupled to a power voltage. An OLED has an anode coupled to the second terminal of the driving transistor, and a cathode coupled to a common electrode. A storage capacitor has one terminal coupled to the control terminal of the driving transistor. A neutralization control circuit is coupled between the OLED and a first voltage, according to a control signal, to pull down the potential at the anode of the OLED thereby inducing a reverse current to neutralize the carrier accumulation in the OLED. The potential of the first voltage is lower than that at the cathode of the OLED.

BRIEF DESCRIPTION OF THE DRAWINGS

The present invention can be more fully understood by reading the subsequent detailed description and examples with reference made to the accompanying drawings, wherein.

DETAILED DESCRIPTION OF THE INVENTION

Figure 1:
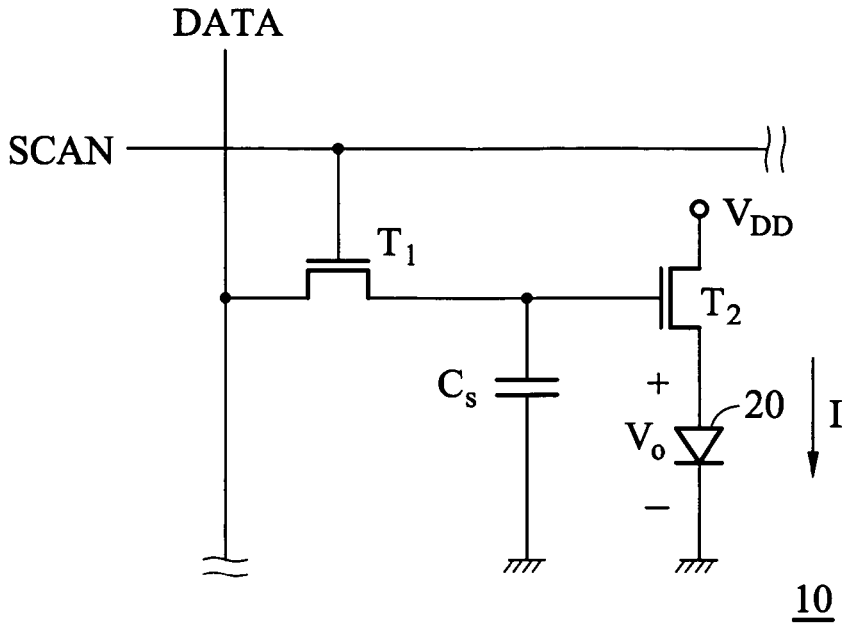
FIG. 1 (RELATED ART)
FIG. 1 shows a pixel structure of a conventional active matrix OLED display.
Figure 2:
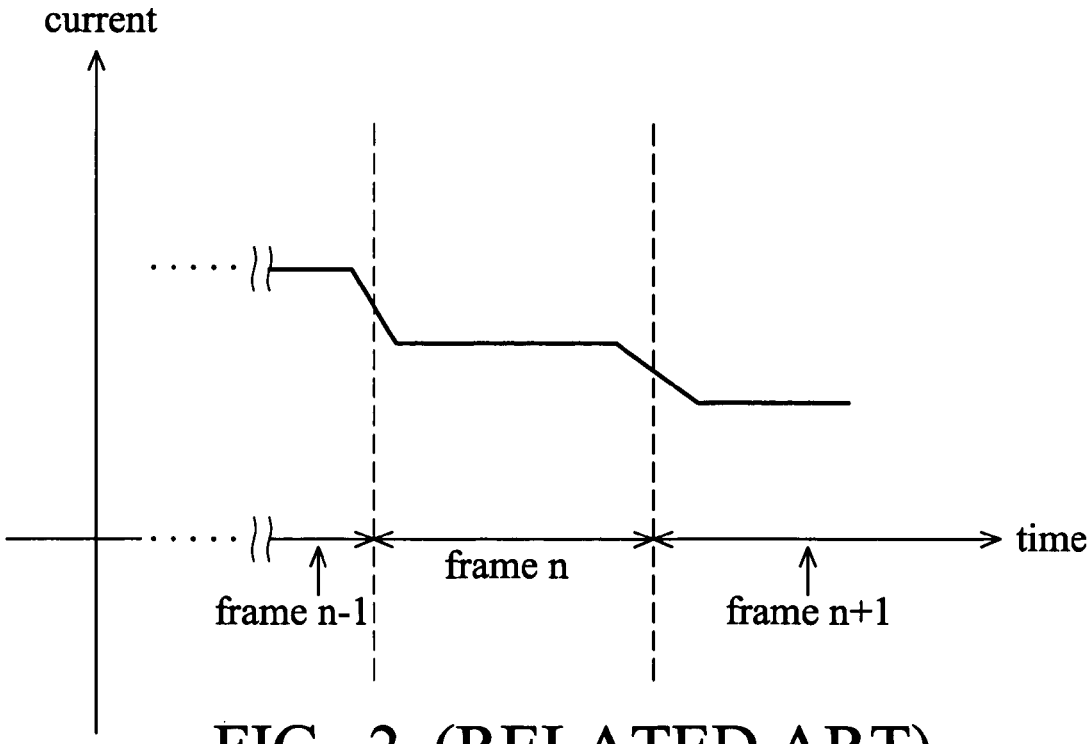
FIG. 2 (RELATED ART)
FIG. 2 is a schematic diagram illustrating a conventional driving method for active matrix OLED display.
Figure 3:
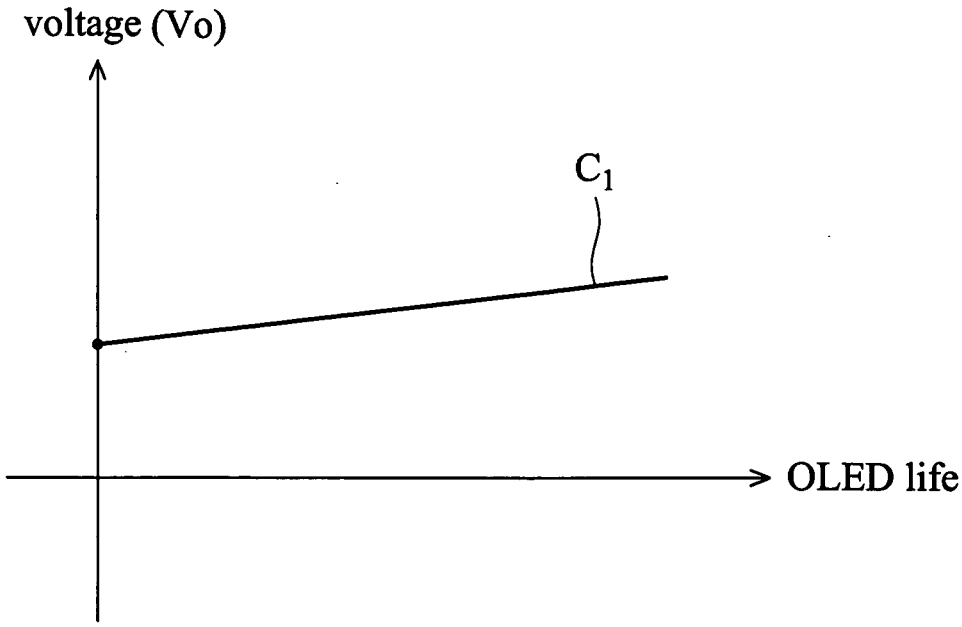
FIG. 3 (RELATED ART)
FIG. 3 shows the relationship between the voltage across both ends of the OLED and its life in the conventional pixel structure.
Figure 4:
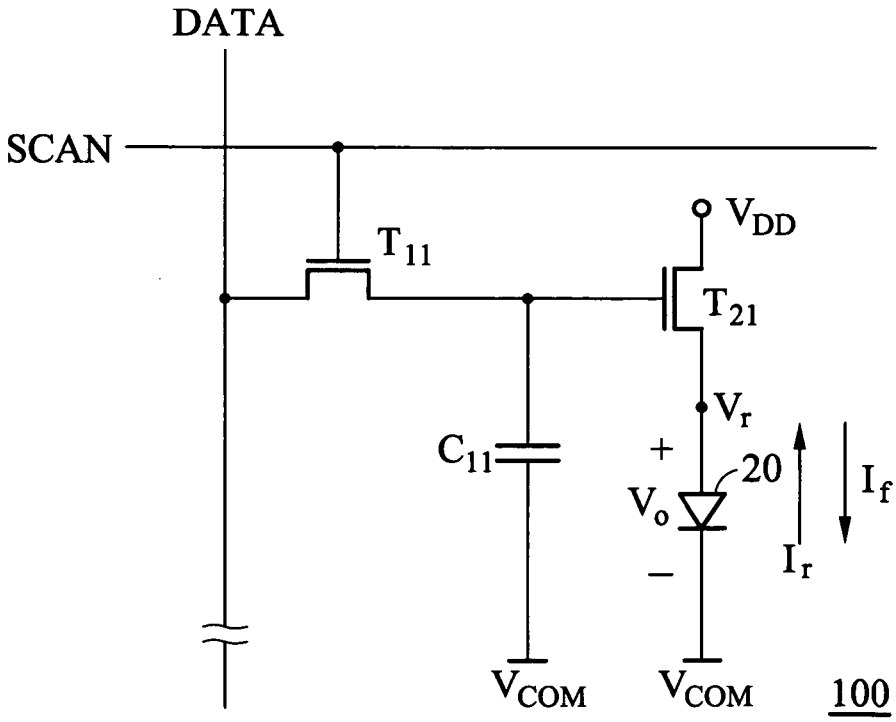
FIG. 4 is a diagram illustrating a driving method of the present invention.

FIG. 4 shows a pixel structure 100 of an active matrix OLED display. In the pixel structure 100, the switching transistor $T_{11}$ has a control terminal coupled to a scan electrode SCAN, and a first terminal coupled to a data electrode DATA. A driving transistor $T_{21}$ has a control terminal coupled to a second terminal of the switching transistor $T_{11}$, and a first terminal coupled to a power voltage $V_{DD}$. An OLED 20 has an anode coupled to the second terminal of the driving transistor $T_{21}$, and a cathode coupled to a common electrode (not shown), wherein the common electrode has a potential of $V_{COM}$. A storage capacitor $C_{11}$ has one terminal coupled to the control terminal of the driving transistor $T_{21}$.

Figure 6:
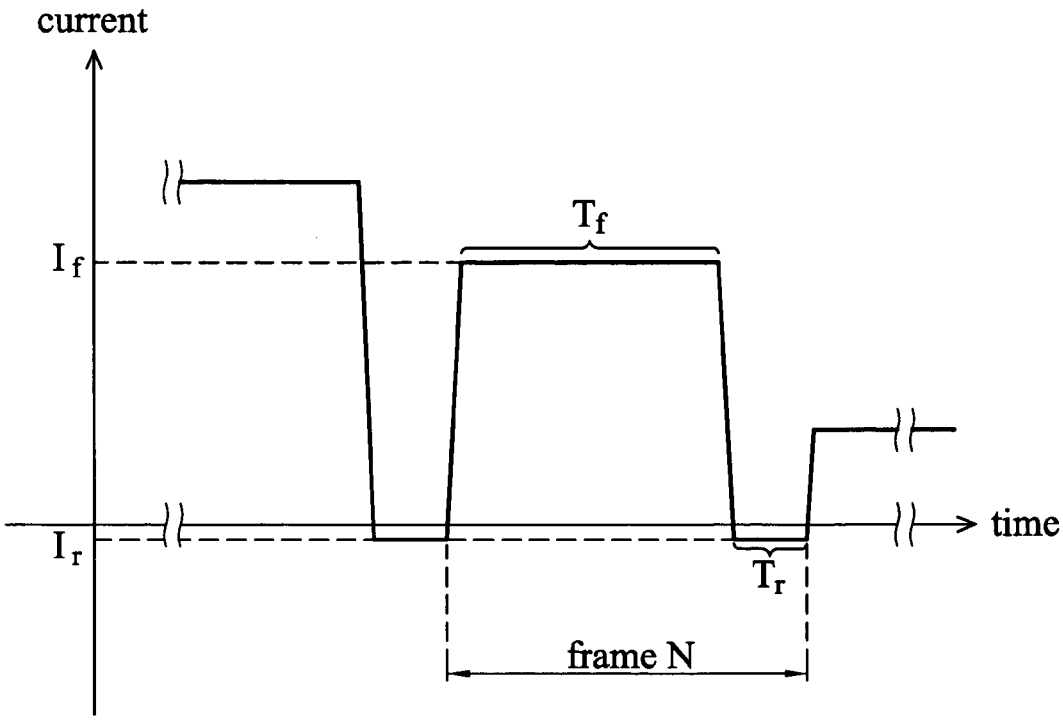
FIG. 6 is another diagram illustrating the driving method of the present invention.

The driving method of the present invention is described below with reference to FIG. 4 and FIG. 6. First, in a first period $T_f$ of one display frame N, a first current is provided and flows through the OLED 20 according to a data signal on the electrode DATA and a scan signal on the scan electrode SCAN. That is, the switching transistor $T_{11}$ is turned on and the storage capacitor $C_{11}$ is charged or discharged by the data signal on the data electrode DATA according to the scan signal on the scan electrode SCAN. At this time, the gate voltage of the driving transistor $T_{21}$ can be adjusted and stored in the storage capacitor $C_{11}$. The driving transistor $T_{21}$ provides the first current $I_f$ to flow through the OLED 20 according to the gate voltage of the transistor $T_{21}$, and the OLED illuminates accordingly. The switching transistor $T_{11}$ is then turned off, but driving transistor $T_{21}$ is still turned on according to the voltage stored in the storage capacitor $C_{11}$, and the OLED 20 illuminates with the same brightness. Because of the above mentioned step, carrier accumulation in the OLED 20, and further, the voltage across both ends of the OLED 20 increases as over time. Thus, the effective life of the OLED 20 may be reduced.

In view of this, the present invention provides a step of providing a second current $I_r$ opposite to the first current $I_f$ to flow through the OLED in a second period $T_r$ of the display frame N. For example, the current $I_f$ flows from anode to cathode and the current $I_r$ flows from cathode to anode, and vice versa. In the present invention neutralizes carrier accumulation in the OLED 20 by the second current $I_r$. The time ratio of the first period $T_f$ to the second period $T_r$ can be between 1:1~$10^5$:1, for example 10:1.

In this embodiment, the second current $I_r$ is obtained by pulling up the potential $V_{COM}$ at the cathode of the OLED higher than the power voltage $V_{DD}$. As the potential $V_{COM}$ at the cathode of the OLED 20 is higher than the power voltage $V_{DD}$, the potential $V_{COM}$ is higher than the voltage $V_r$ at the anode of the OLED 20. Thus, the voltage $V_o$ across the OLED 20 becomes negative, and the second current $I_r$ opposite to the first current $I_f$ is produced to neutralize the carrier accumulation in the OLED 20. In addition, the second current $I_r$ opposite to the first current $I_f$ can also be obtained by providing a negative voltage across the anode and cathode of the OLED. Alternately, the second current $I_r$ can be provided to flow through the OLED 20 before each first period $T_f$ (first current $I_f$) of the display frame N.

Figure 5:
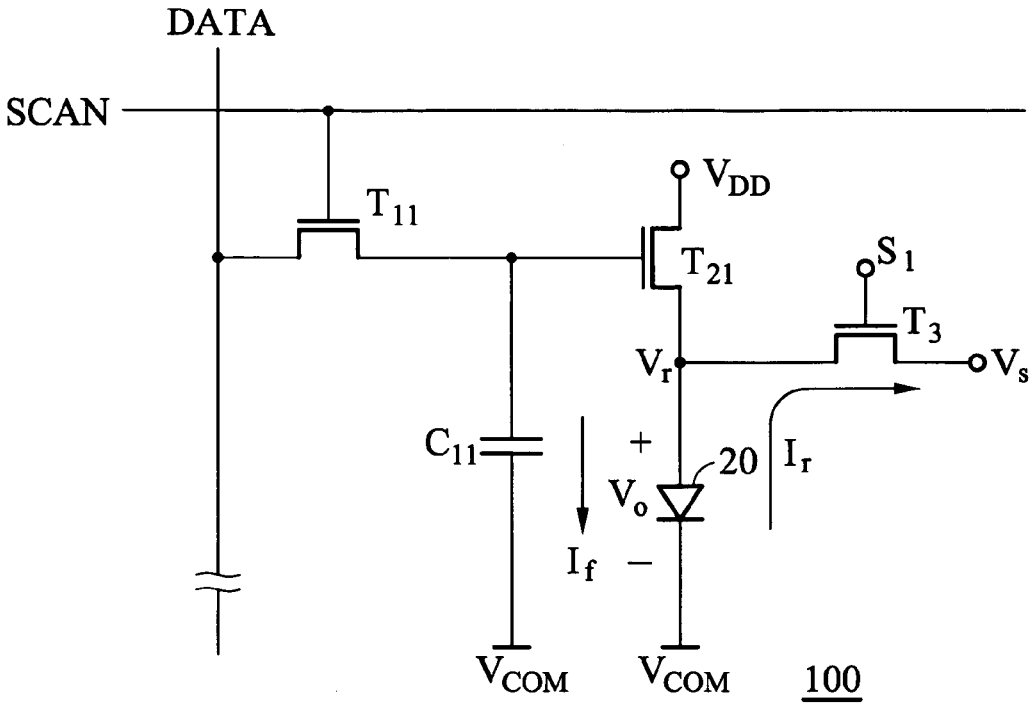
FIG. 5 shows the pixel structure of an active matrix OLED display according to the present invention.

Additionally, the present invention provides a pixel structure capable of neutralizing carrier accumulation in OLED, as shown in FIG. 5. In FIG. 5, a switching transistor $T_{11}$ has a control terminal coupled to a scan electrode SCAN and a first terminal coupled to a data electrode DATA. A driving transistor $T_{21}$ has a control terminal coupled to a second electrode of the switching transistor $T_{11}$ and a first terminal coupled to a power voltage $V_{DD}$. The OLED 20 has an anode coupled to the second terminal of the driving transistor $T_{21}$, and a cathode coupled to a common electrode (not shown) A storage capacitor $C_{11}$ has one terminal coupled to the control terminal of the driving transistor $T_{21}$.

The present invention utilizes a transistor $T_3$ as a neutralization control circuit coupled between the OLED and a first voltage $V_s$, wherein the potential of the first voltage $V_s$ is lower than the potential $V_{COM}$ at the cathode of the OLED 20. In the second period $T_r$ of the display frame N, the transistor $T_3$ pulls the potential $V_r$ at the anode of the OLED 20 lower than the potential $V_{COM}$, according to a control signal $S_1$. At this time, the voltage $V_o$ across the OLED 20 becomes negative, and thus a reverse current $I_r$ opposite to the current $I_f$ is induced to neutralize carrier accumulation in the OLED 20. For example, the current $I_f$ flows from anode to cathode and the current $I_r$ flows from cathode to anode, and vice versa. The time ratio of the first period $T_f$ (current $I_f$) between and the second period $T_r$ (current $I_r$) can be 1:1~$10^5$:1, for example 10:1. The embodiment of the present invention for producing a reverse current to flow through an OLED is provided as an example, and is not intended to constrain the application of this invention.

Figure 7:
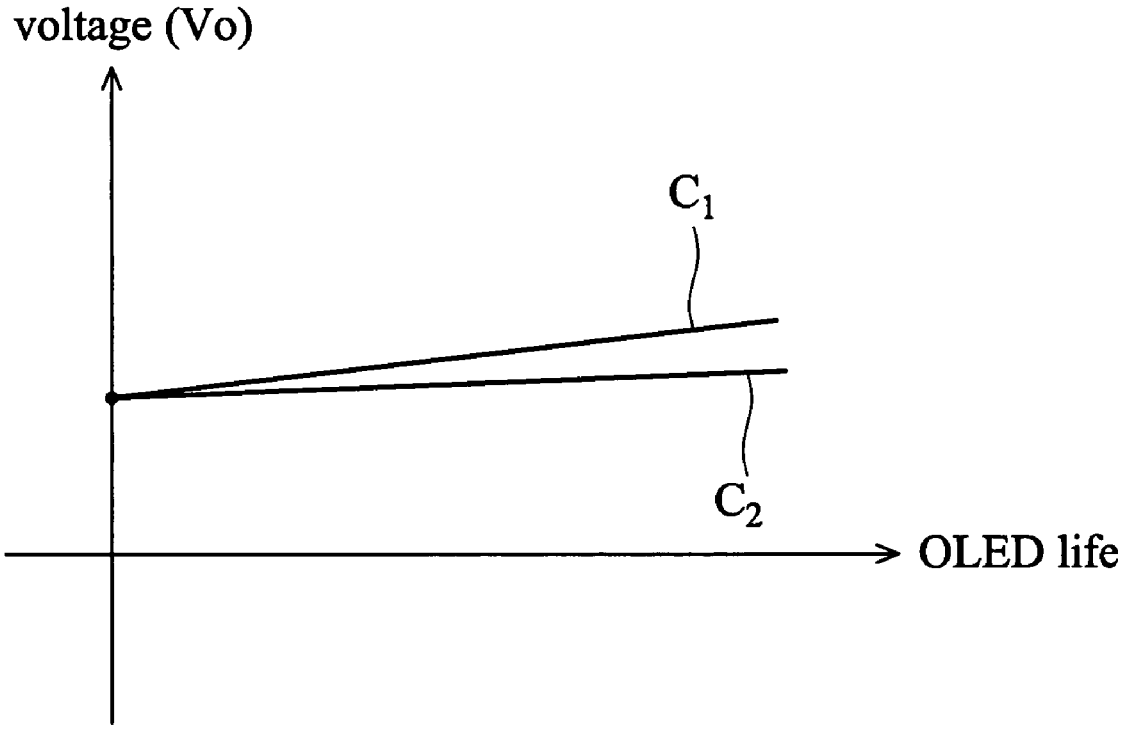
FIG. 7 shows the relationship between the voltage across both ends of the OLED and its life using the conventional driving method and that of the present invention.

FIG. 7 shows the relationship between the voltage $V_o$ across both ends of the OLED 20 and its life using the conventional driving method and the method of the present invention. Curve $C_1$ shows the relationship between the voltage $V_o$ across both ends of the OLED 20 and its life in the present invention. Curve $C_2$ show the relationship between the voltage $V_o$ across both ends of the OLED and its life using the conventional driving method. Obviously, the present invention can reduce increased voltage across both ends of the OLED over time. Additionally, the present invention can also reduce increased power consumption of to OLED over time, as shown by the formula P=I×V.

Figure 8:
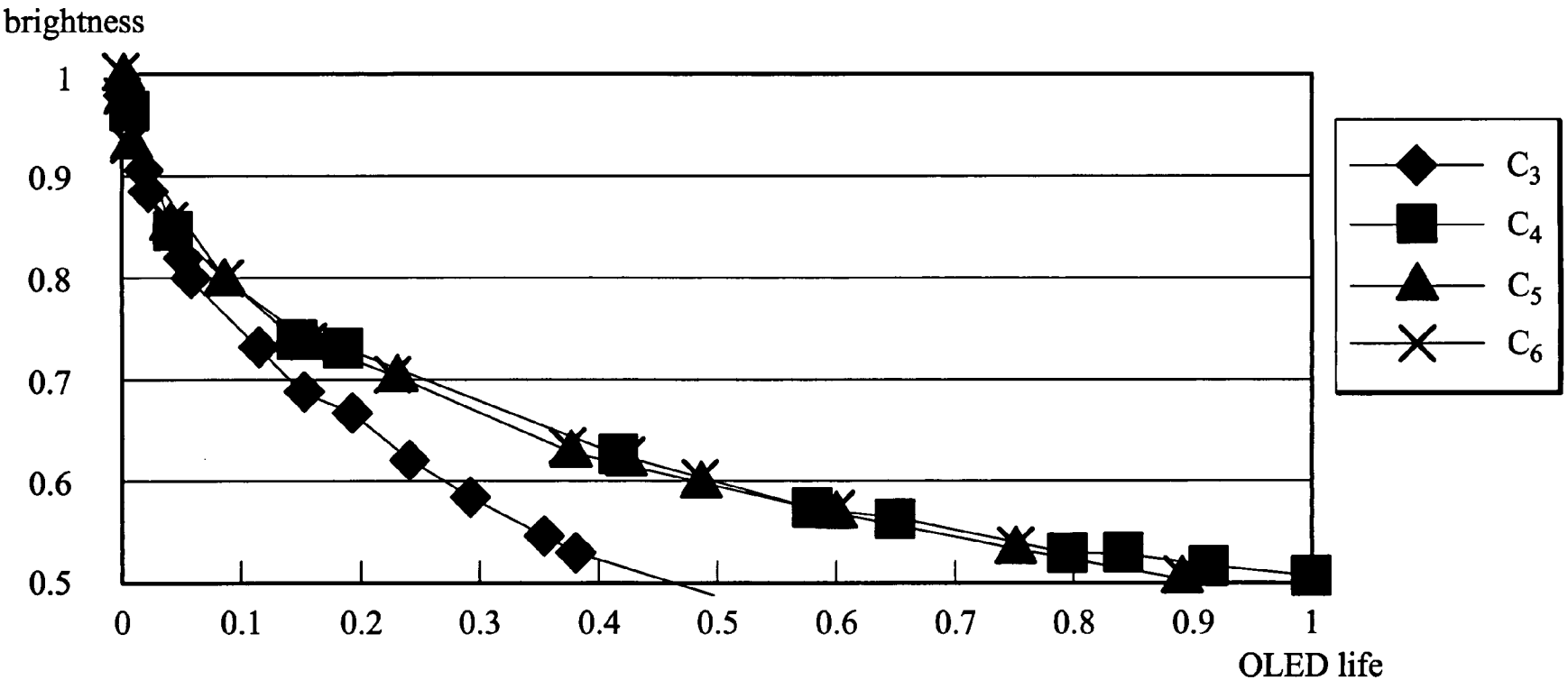
FIG. 8 shows the relationship between the brightness and OLED life according to the present invention.

FIG. 8 shows the relationship between the brightness and the life of an OLED according to the present invention. In FIG. 8, curve $C_3$ shows the relationship between the brightness and the life of an OLED without using a reverse current to neutralize carrier accumulation in the OLED. Curve $C_4$ shows the relationship between the brightness and the life of an OLED with a reverse current $I_r$ to neutralize carrier accumulation in the OLED, wherein the time ratio of the first period $T_f$ (current $I_f$) to the second period $T_r$ (current $I_r$) is 10:1. Curve C5 shows the relationship between the brightness and the life of an OLED using the reverse current, wherein the time ratio of the first period $T_f$ (current $I_f$) to the second period $T_r$ (current $I_r$) is 100:1. Curve $C_5$ shows the relationship between the brightness and the life of an OLED with the reverse current, wherein time ratio of the first period $T_f$ (current $I_f$) to the second period $T_r$ (current $I_r$) is 500:1. As shown in FIG. 8, the life of OLED using a reverse current to neutralize carrier accumulation therein is about double of the conventional OLED and driving method not employing reverse current. Therefore, the present invention reduces the increase in voltage and minimizes the increase in power consumption across both ends of the OLED over time, further increasing the life of the OLED.

Furthermore, in the present invention, a period for producing a reverse current to neutralize carrier accumulation in the OLED is not limited to one display frame but extend to two or more display frames. For example, the first, fourth and seventh display frames each have a period for producing a reverse current to neutralize carrier accumulation in the OLED. The second, third, fifth and sixth display frames have no period for producing a reverse current to neutralize carrier accumulation in an OLED.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A pixel structure for active matrix OLED display, comprising:

a switching transistor having a control terminal coupled to a scan electrode and a first terminal coupled to a data electrode;

a driving transistor having a control terminal coupled to a second electrode of the switching transistor and a first terminal coupled to a power voltage;

a OLED having an anode coupled to the second terminal of the driving transistor, and a cathode coupled to a common electrode;

a storage capacitor coupled between the control terminal of the driving transistor and the common electrode, controlling turning on/off of the driving transistor according to data stored therein when the switch transistor is turned off; and a first transistor comprising a first terminal coupled to the anode of the OLED and a second terminal coupled to a first voltage and a control terminal coupled to a control signal, pulling down the potential at the anode of the OLED according to the control signal thereby inducing a reverse current to neutralize carrier accumulation inside the OLED, wherein the first voltage is variable and is determined by the data stored in the storage capacitor and the control signal is applied to turn on the first transistor during an $N^{th}$ frame and an $N+M^{th}$ frame, N and M are both positive integrals and M>1.

2. The pixel structure as claimed in claim 1, wherein the potential of the first voltage is lower than that at the cathode of OLED.

3. An active matrix OLED display, comprising:

at least one pixel, comprising:

a switching transistor having a control terminal coupled to a scan electrode and a first terminal coupled to a data electrode;

a driving transistor having a control terminal coupled to a second electrode of the switching transistor and a first terminal coupled to a power voltage;

a OLED having an anode coupled to the second terminal of the driving transistor, and a cathode coupled to a common electrode;

a storage capacitor to coupled between the control terminal of the driving transistor and the common electrode, controlling turning on/off of the driving transistor according to data stored therein when the switch transistor is turned off; and a first transistor comprising a first terminal coupled to the anode of the OLED and a second terminal coupled to a first voltage and a control terminal coupled to a control signal, pulling down the potential at the anode of the OLED according to the control signal thereby inducing a reverse current to neutralize carrier accumulation inside the OLED, wherein the first voltage is variable and is determined by the data stored in the storage capacitor and the control signal is applied to turn on the first transistor during a $N^{th}$ frame and a $N+M^{th}$ frame, N and M are both positive integrals and M>1.

4. The active matrix OLED display as claimed in claim 3, wherein the potential of the first voltage is lower than that at the cathode of OLED.

5. A driving method for an active matrix OLED display, wherein the display has at least one pixel, each having a switch transistor, a driving transistor, an OLED and a storage capacitor, the driving method comprising:

providing a first transistor coupled between an anode of the OLED and a first voltage;

turning on the switching transistor to provide a display data on a data electrode to the storage capacitor and the driving transistor according to a scan signal, wherein the first voltage is variable and is determined by the display data stored in the storage capacitor;

turning on the driving transistor to providing a first current to flow through the OLED of the pixel according to the display data stored the storage capacitor; and turning on the first transistor to provide a second current to flow through the OLED to neutralize carrier accumulation inside the OLED according to a control signal during an $N^{th}$ frame and an $N+M^{th}$ frame, wherein N and M are both positive integrals, M>1, and the first current and the second current flow in opposite directions.

6. The driving method as claimed in claim 5, wherein the potential of the first voltage is lower than that at the cathode of OLED.

* * * * *